US005123976A

United States Patent [19]

Brissonneau et al.

[11] Patent Number: 5,123,976

[45] Date of Patent: Jun. 23, 1992

[54] PROCESS OF ALUMINIZATION OF SHEETS OF MAGNETIC STEEL WITH ORIENTED GRAINS

[75] Inventors: Pierre Brissonneau, Grenoble; Jean-Luc Laverny, St Chely d'Apcher; Jean-Claude Perrier, Poisat; Jean Verdun, Suresnes, all of France

[73] Assignee: Ugine, Aciers de Châtillon et Gueugnon, Puteaux, France

[21] Appl. No.: 646,710

[22] Filed: Jan. 28, 1991

[51] Int. Cl.[5] ..... H01F 41/22; C21D 8/12

[52] U.S. Cl. ..... 148/111; 148/112; 148/113

[58] Field of Search ..... 148/112, 113, 111

[56] References Cited

U.S. PATENT DOCUMENTS 3,756,867 9/1973 Brissonneau et al. ..... 148/112
3,764,381 10/1973 Brissonneau ..... 148/113
4,177,092 12/1979 Thursby ..... 148/113
4,225,366 9/1980 Harase et al. ..... 148/113
5,013,374 5/1991 Block et al. ..... 148/113

FOREIGN PATENT DOCUMENTS 1525034 4/1968 France .

*Primary Examiner*—George Wyszomerski
*Attorney, Agent, or Firm*—Frishauf, Holtz, Goodman & Woodward

[57] ABSTRACT

A process of aluminizing magnetic steel sheets is disclosed. The process involves annealing a steel sheet in order to achieve partial secondary recrystallization, providing aluminum on the steel sheet, preferably by vacuum evaporation or immersion, and subjecting the steel sheet to a further heat treating step in order to diffuse the aluminum into the sheet and decrease impurities therein. Preferably, the partial secondary recrystallization anneal is performed in a neutral atmosphere such as nitrogen, while the final heat treating step is performed in a hydrogen atmosphere, and at a higher temperature than the above annealing step.

21 Claims, 2 Drawing Sheets

PROCESS OF ALUMINIZATION OF SHEETS OF MAGNETIC STEEL WITH ORIENTED GRAINS

The subject of the present invention is a process of aluminization of sheets of magnetic steel with oriented grains.

The sheets of magnetic steel with oriented grains, for example with a GOSS texture, are used in the construction of electric machines, in particular transformers where their magnetic properties play an important role.

It is particularly advantageous to reduce losses in the magnetic sheets used in electric machines, as much from hysteresis as from eddy currents, by increasing the resistivity of the metal by addition of alloying elements such as aluminum and by taking into account the thickness of the said sheets, which is related to the thickness of skin which is itself dependent on the anticipated working frequencies.

It is imperative that the oriented texture must be retained after this addition of aluminum.

It is known from FR-A-1 525 034, that there is a process which consists in coating each side of the sheet with a layer of aluminum, of silicon, or of germanium, in causing this element to diffuse by heat treatment into the matrix, and in subsequently carrying out on the metal so obtained a heat treatment in a magnetic field to improve the configuration of the Weiss domains and to obtain the desired structure.

In this process, the diffusion is carried out at a temperature of between 750° C. and 1050° C., more particularly at 900° C. for three hours under a hydrogen atmosphere. After this static treatment, a hot planishing treatment is essential. The latter heat treatment is carried out in an oven by going up to a temperature of the order of 900° C., for a few minutes, followed by a cooling in a magnetic field, when the temperature is between 600° C. and 300° C.

Such a process has the major disadvantage of requiring a special heat treatment at an elevated temperature so as to cause the aluminum to diffuse. The aluminization stage is a stage preceding the working-up of the texture of the grains of the sheets.

It is also known from FR-A-2 067 409, that there is a process for manufacturing sheets, with oriented grains with high magnetic properties in the direction of rolling, starting with a strip of steel suitable for acquiring the GOSS texture, but not yet possessing this texture, this by virtue of a suitable composition of the steel and an appropriate cold rolling followed by a decarbonization annealing until there is less than 0.005% of carbon. A deposition of aluminum is carried out on said strip, followed by a hot diffusion of this aluminum throughout the mass of the strip to be treated, in the solid phase, this diffusion of aluminum taking place before carrying out the hot secondary recrystallization to GOSS texture.

The cold-rolled strip, decarbonized, is wrapped around with a strip of aluminum. This wrapping is followed by two successive heat treatments, at two different temperatures, it being possible for it to take place in the same oven or not, with or without returning to ambient temperature between the two treatments. The first treatment, between 600° and 800° C., produces the diffusion of aluminum in the strip to be treated, and the second treatment, between 950° and 1250° C., produces the secondary recrystallization to GOSS texture.

In the two processes described, the aluminum diffusion stage is carried out before the recrystallization to GOSS texture.

The process according to the present invention relates to the manufacture of aluminized sheets of magnetic steel with oriented grains, comprising an aluminization operation carried out during the process of recrystallization of the grains of the magnetic sheet, which, compared to the previously mentioned techniques, leaves out the heat treatment specific to aluminum diffusion in the manufacture of sheets while maintaining the texture of oriented grains.

To this end, the process of aluminization of a sheet of magnetic steel with oriented grains which has undergone at least one cold rolling, at least one annealing under a hydrogen atmosphere, followed by a decarbonization annealing, the grains of the sheet then being in the state of primary recrystallization, is characterized by the fact that a deposition of aluminum is carried out on the said sheet between two stages of a final annealing, of which the first stage produces a partial or total secondary recrystallization of the grains of the sheet and of which the second stage permits the diffusion of aluminum and the elimination of impurities.

The process is further characterized by the fact that the first stage of the final annealing comprises:

- an increase in temperature at about 40° C. per hour under an atmosphere of neutral gas,
- a first holding step, of which the temperature is between 800° C. and 1050° C. and the duration between half an hour and five hours, under an atmosphere of neutral gas,
- a natural cooling under neutral gas,
- and by the fact that the second stage of the final annealing comprises:
- a rapid increase in temperature at about 450° C. per hour up to the temperature of the first holding step, then an increase in temperature of about 40° C. per hour,
- a second holding step, of which the temperature is between 1080° C. and 1200° C. and the duration between half an hour and five hours under a hydrogen atmosphere.

Preferably:

- the temperature of the first holding step is 890° C.,
- the duration of the first holding step is four hours,
- the temperature of the second holding step is 1180° C.,
- the duration of the second holding step is four hours.

According to other features of the invention:

- the deposition of aluminum is carried out by means of at least one foil of aluminum placed in contact with the sheet,
- the deposition of aluminum is carried out by vacuum evaporation,
- the deposition of aluminum is carried out by immersion in a bath of molten aluminum,
- after treatment, the aluminum content in the sheet is between 1 and 5%.

The invention also relates to a sheet of magnetic steel obtained according to this process.

Such a process of aluminization is now described by referring to comparative tests which, with reference to the attached drawings, will highlight the characteristics of the magnetic sheet according to the invention.

Figure 1:
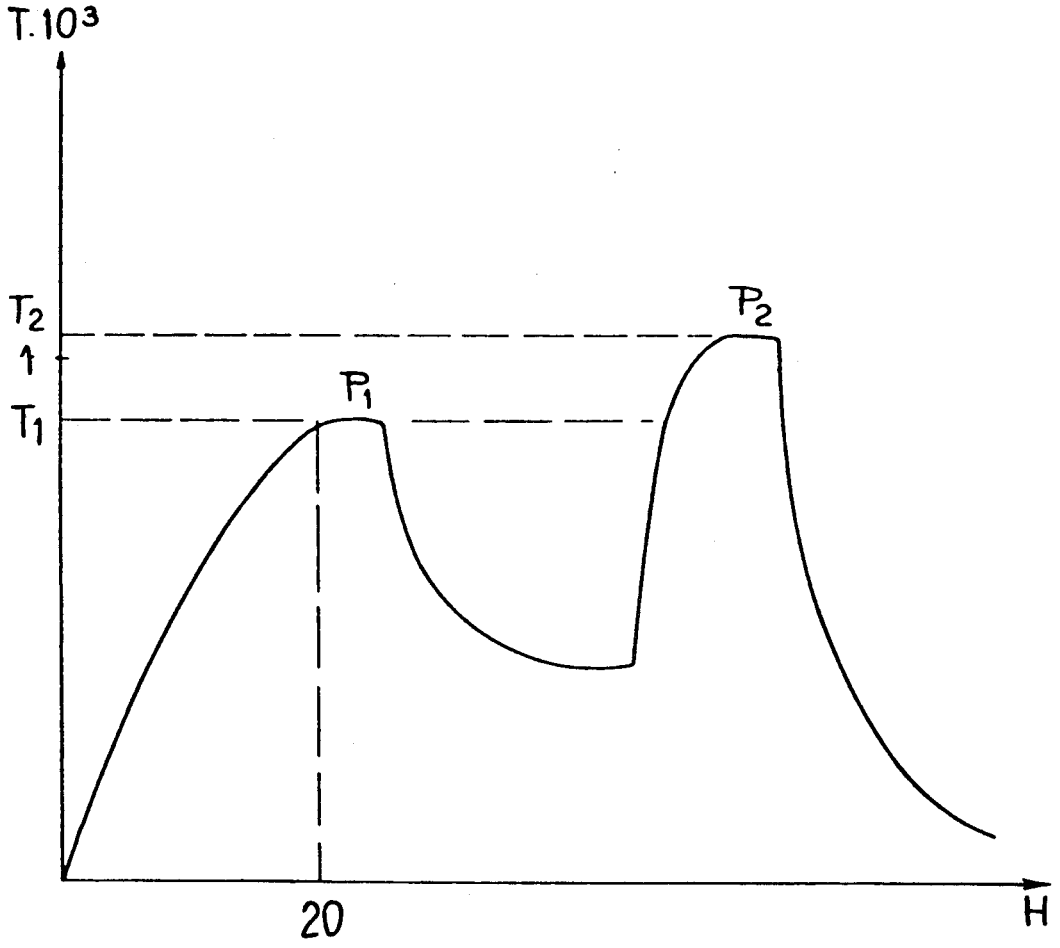
FIG. 1 shows an example of the temperature profile of a final annealing.

FIG. 1 gives an example of the temperature profile of a final annealing comprising an increase in temperature of about 40° C. per hour. The sheet to be treated is then placed under an atmosphere of neutral gas, which can be for example nitrogen, and maintained at a first holding step $P_1$ which can vary from thirty minutes to five hours at a temperature $T_1$ of between 800° C. and 1050° C. This holding step permits a nucleation of crystals having for example the GOSS orientation. After passing through the holding step $P_1$, the sheet is cooled naturally to a temperature allowing a deposition of aluminum by various methods such as evaporation, immersion in a molten bath, contact with aluminum foils.

Next, the aluminized sheet is maintained at a second holding step $P_2$, under a hydrogen atmosphere, for a time between thirty minutes and five hours at a temperature $T_2$ of between 1080° C. and 1200° C.

The increase in the temperature is carried out at a constant rate of 450° C. per hour up to the temperature $T_1$ of the holding step $P_1$, then at 40° C. per hour to reach the temperature $T_2$ of the holding step $P_2$, the cooling then happening naturally under hydrogen.

By way of comparison, samples taken from a coiled Fe-Si 3% sheet have been subjected to the following various treatment tests:

1 Heat treatment of final annealing in two stages without aluminization,
2. Aluminization after the annealing in two stages followed by an aluminum diffusion operation,
3. Aluminization before the final annealing in two stages,
4. Aluminization after the first stage of the final annealing.

The coiled sheet of Fe-Si 3% alloy is worked up from a hot-rolled sheet of two millimeters thickness subjected to:

a) a first cold rolling to achieve an intermediate thickness of 0.49 mm,
b) a process annealing in passing to 950° C. under a hydrogen atmosphere, followed by a second cold rolling to the final thickness of 0.23 mm,
c) a decarbonization in passing to 820° C. under a hydrogen and nitrogen atmosphere,
d) a coating with a coat of magnesia (MgO) or of alumina ($Al_2O_3$),
e) and a final annealing in two stages comprising:
   A first annealing of four hours at 890° C. corresponding to the temperature $T_1$ of the holding step $P_1$, under a nitrogen atmosphere, with a slow increase in temperature at 40° C. per hour, the annealing being followed by a natural cooling,
   A second annealing of four hours at 1100° C. corresponding to the temperature $T_2$ of the holding stage $P_2$, under a hydrogen atmosphere, with rapid increase up to the temperature $T_1$, then a slow increase at 40° C. per hour, up to the temperature $T_2$ of the holding step $P_2$, the annealing being followed by a natural cooling.

It is necessary to cover the surface of the sheets with a non-stick coat which can be easily removed. The texture of the sheets is not altered by the use of a non-stick coat such as magnesia or alumina.

The magnetic properties, magnetic losses and induction B 800 (under an excitation field of 800 A/m) for a sheet which has undergone the heat treatment 1, without aluminization, are shown in Table I:

TABLE I

| | Losses in mW/cm³ Fe—Si 3% | | Magnetization B800 in Tesla |
|---|---|---|---|
| | 1 T | 1.5 T | DC current |
| 50 Hz | 3.21 | 6.58 | 1.86 |
| 400 Hz | 59.2 | 135 | |

The magnetization at saturation Bs=2.01 Tesla.

$$\text{The ratio } \frac{B800}{Bs} = \frac{1.86}{2.01} = 0.925$$

The aluminum used for the aluminization step is a foil, of which the composition by weight of residual elements is the following: Iron: 0.20%; Silicon: 0.20 to 0.30%; Titanium: 0.015%

The foil is, moreover, in the annealed state.

For example, aluminum foils of 9 micron thickness are used for the sheets of 0.23 mm thickness. After treatment, the average aluminum content is then in the region of 1.3% and the density of the samples is close to 7.52.

The density of the aluminized sheets differs substantially from the density of the basic alloy Fe-Si 3%. A fair comparison of the physical properties requires that the losses be expressed on a per unit volume basis, for example in mW/cm³.

The aluminization treatment 2 is carried out by using a foil on both sides of the magnetic sheet after the latter has undergone the two stages of the final annealing.

It is therefore necessary to carry out an additional heat treatment on this sheet-strip combination for the purpose of causing the aluminum to diffuse. The diffusion operation comprises the following stages:

An increase in temperature of 40° C. per hour,
A holding step of four hours at 1050° C. under neutral gas.
A natural cooling under neutral gas.

The magnetic properties are shown in Table II below:

TABLE II

| | Losses in mW/cm³ Fe—Si 3% + 1.3% Al. | | Magnetization B800 in Tesla |
|---|---|---|---|
| | 1 T | 1.5 T | DC current |
| 50 Hz | 2.86 | 6.32 | 1.813 |
| 400 Hz | 55.2 | 125 | |

The magnetization at saturation is then Bs=1.93 Tesla.

$$\text{The ratio } \frac{B800}{Bs} = \frac{1.81}{1.93} = 0.937$$

This ratio differs very little from that obtained before aluminization (Table I). The texture therefore is not altered.

The aluminization treatment 3 is carried out by using the aluminum foil on both sides of the sheet before the two stages of the final annealing, as recommended in FR-A-2 067 409.

The magnetic properties obtained are collated in Table III below.

TABLE III

| | Losses in mW/cm³ Fe—Si 3% + 1.3% Al. | | Magnetization B800 in Tesla |
|---|---|---|---|
| | 1 T | 1.5 T | DC current |
| 50 Hz | 3.91 | 9.70 | 1.598 |

The magnetization at saturation is Bs = 1.93.

$$\text{The ratio } \frac{B800}{Bs} = 0.827$$

The aluminization before the two stages of the final annealing has a very unfavourable influence on the mechanisms of secondary recrystallization. When observed macroscopically, the grains appear irregular, of small size, such as they are after the stage of primary growth. The properties in terms of magnetic losses confirm that the process of aluminization before the two stages of the final annealing gives results that are less good than in the test of final annealing without aluminum.

The aluminization treatment 4 according to the invention is carried out by using the aluminum foil on both sides of the sheet between the two stages of the final annealing, that is to say after a secondary recrystallization of the grains of the sheet.

The magnetic properties are collated in Table IV below.

TABLE IV

| | Losses in mW/cm³ Fe—Si 3% + 1.3% Al. | | Magnetization B800 in Tesla |
|---|---|---|---|
| | 1 T | 1.5 T | DC current |
| 50 Hz | 2.92 | 6.39 | 1.80 |
| 400 Hz | 56.80 | 131 | |

The magnetization at saturation is Bs1.93 Tesla.

$$\text{The ratio } \frac{B800}{Bs} = 0.935$$

The magnetic properties after treatment 3 and collated in Table III confirm that the process of aluminization, before final annealing, does not improve the loss properties of the sheet. This is why, splitting the final secondary recrystallization annealing into two stages, aluminum is added at the intermediate stage, that is to say after the mechanisms of secondary recrystallization are at least partially developed.

The nucleation of the texture is accomplished in the course of the first stage of the final annealing during which the mechanisms of recrystallization were able to come into play.

This study shows that the aluminization carried out in the course of the final annealing gives results substantially identical to those obtained with an aluminization carried out after the final annealing.

The deposition of aluminum can be carried out either by vacuum evaporation, or by immersion in a bath of molten aluminum.

After treatment, the aluminum content in the sheet is between 1 and 5%, and equal to 1.3 in the example.

Figure 2:
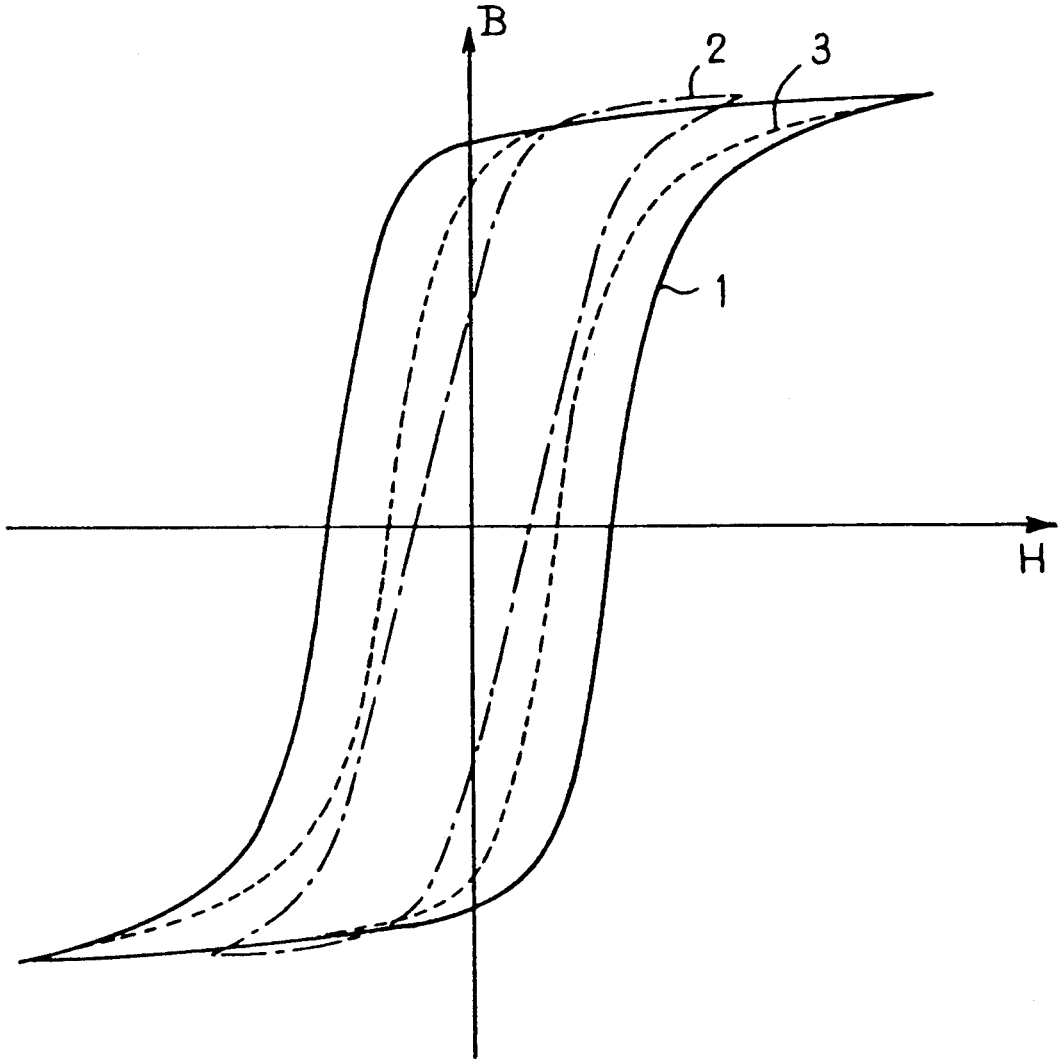
FIG. 2 shows three hysteresis cycles corresponding to three comparative aluminization tests.

The variations in the hysteresis cycle shown in FIG. 2 for an induction B = 1.5 Tesla as a function of the aluminization shows the advantage of such a process.

In this FIG. 2, the curves represent hysteresis cycles of the alloys Fe-Si (treatment 1) and Fe-Si-Al: (treatments 2 and 4).

The curve 1 represents the cycle for the alloy Fe-Si before aluminization and after the final annealing operation, The curve 2 represents the hysteresis cycle of the alloy Fe-Si-Al for a treatment the aluminization (sic) after the annealing in two stages followed by an aluminum diffusion operation, The curve 3 represents the hysteresis cycle for the alloy Fe-Si-Al after aluminization, the aluminization being carried out after the first stage of the final annealing.

It is observed that the differences between the hysteresis cycles for the two processes of aluminization are slight and that the variation between the two cycles with aluminization and the cycle Fe-Si without aluminum is considerable.

A sheet of thickness 0.23 mm used in equipment working especially at 400 Hz is the source of considerable induced currents which generate additional losses and limit the response time in, for example, control circuits using semiconductor power components. Under these condition (sic) there is every advantage in working with materials of much smaller thickness.

In another example, a sheet of magnetic steel with oriented grains was produced, by the process according to the invention corresponding to the treatment 4, the sheet having a thickness of about 0.15 mm.

The properties of the sheet produced in this way are collated in the Table V below.

TABLE V

| | Losses in mW/cm³ Fe—Si 3% + 1.3% Al. | | Magnetization B800 in Tesla |
|---|---|---|---|
| | 1 T | 1.5 T | DC current |
| 50 Hz | | 5.69 | 1.81 |
| 400 Hz | | 101 | |

It will be noted that the magnetic sheet of 0.15 mm obtained by the process gives a substantial reduction in the magnetic loss properties in comparison with the loss properties of sheets of thickness 0.23 mm obtained by the same process.

The process according to the invention permits an aluminization of the sheets with oriented grains during the course of their working-up by using the second stage of the final annealing to ensure the diffusion of the aluminum and the elimination of sulfur and other impurities.

Furthermore, this process permits a considerable saving, especially of energy, by leaving out a hightemperature heat treatment stage, compared to the process brought about by the curve 2.

The temperatures of heat treatment and the durations are likely to vary as a function of the thicknesses and of the initial compositions of the sheets to be aluminized; the example which has just been given relates to currently used magnetic sheets with oriented grains.

Likewise, the deposition of aluminum is carried out by means of foils, but identical results are obtained by vacuum deposition or immersion in a bath of molten aluminum.

We claim:

1. A process for aluminizing a sheet of magnetic steel which includes magnetically oriented grains and impurities including carbon therein, and wherein the sheet of magnetic steel has been cold rolled at least once, then annealed at least once in a hydrogen atmosphere, and then annealed again to decrease the impurities including carbon therein, whereby the magnetically oriented grains in said sheet of magnetic steel are in a state of primary recrystallization, the process comprising the steps of:

finally annealing said sheet of magnetic steel in first and second final annealing steps, the first final annealing step reaching a first temperature which causes an at least partial secondary recrystallization of the magnetically oriented grains;

then after the first final annealing step providing aluminum on said sheet of magnetic steel; and thereafter during the second final annealing step, heating the sheet of magnetic steel to a second temperature which enables the aluminum provided on said sheet of magnetic steel to diffuse into said sheet of magnetic steel and also further decreases said impurities in said sheet of magnetic steel.

2. A process according to claim 1, wherein the second temperature is higher than said first temperature.

3. A process according to claim 2, further comprising:

cooling the sheet of magnetic steel after the first final annealing step; and wherein the second final annealing step comprises:

rapidly increasing the temperature at about 450° C. per hour until said first temperature is reached;

then continuing to increase the temperature at about 40° per hour, until said second temperature is reached, said second temperature being between 1080° C. and 1200° C.;

maintaining the second temperature for a period of time which is at least one-half hour and does not exceed five hours in a hydrogen atmosphere; and then cooling said sheet of magnetic steel in a hydrogen atmosphere.

4. A process according to claim 3, wherein the second temperature is 1180° C.

5. A process according to claim 3, further comprising maintaining said second temperature for four hours.

6. A process according to claim 1, wherein the first final annealing step comprises:

increasing the temperature at about 40° C. per hour in a neutral atmosphere until said first temperature is reached, said first temperature being at least 800° C. and not more than 1050° C.;

holding the first temperature for a period of time which is at least one-half hour and which does not exceed a period of five hours, in a neutral atmosphere; and then cooling the sheet of magnetic steel in a neutral atmosphere.

7. A process according to claim 6, wherein the first temperature is 980° C.

8. A process according to claim 6, wherein the first temperature is held for a period of four hours.

9. A process according to claim 1, further comprising providing said aluminum on said sheet of magnetic steel by placing at least one aluminum foil in contact with the sheet of magnetic steel.

10. A process according to claim 1, further comprising providing said aluminum on said sheet of magnetic steel by vacuum evaporation.

11. A process according to claim 1, further comprising providing said aluminum on said sheet of magnetic steel by immersing said sheet of magnetic steel in a bath of molten aluminum.

12. A process according to claim 1, wherein after the second final annealing step the aluminum content of the sheet of magnetic steel is between one and five percent.

13. A process for aluminizing a sheet of magnetic steel which includes magnetically oriented grains and impurities including carbon therein, comprising the steps of:

primarily recrystallizing said magnetically oriented grains and decreasing the impurities in said sheet of magnetic steel by:

cold rolling said sheet of magnetic steel at least once;

then annealing at least once said sheet of cold rolled magnetic steel in a hydrogen atmosphere; and then annealing said sheet of magnetic steel again to decrease the impurities therein;

at least partially secondarily recrystallizing said magnetically oriented grains in said sheet of magnetic steel in a first final annealing step by heating the sheet of magnetic steel to a first temperature which causes said at least partial secondary recrystallization of said magnetically oriented grains;

then providing aluminum on the sheet of magnetic steel;

thereafter annealing the sheet of magnetic steel with the aluminum provided thereon, in a second final annealing step at a second temperature which enables diffusion of the aluminum into said sheet of magnetic steel and also further reduces the impurities in said sheet of magnetic steel.

14. A process according to claim 13, wherein the first final annealing step to at least partially secondarily recrystallize said magnetically oriented grains comprises:

increasing the temperature at about 40° C. per hour in a neutral atmosphere until said first temperature is reached, said first temperature being at least 800° C. and not more than 1050° C.;

maintaining the first temperature for a period of time which is at least one-half hour and which does not exceed five hours in a neutral atmosphere; and then cooling the sheet of magnetic steel in a neutral atmosphere.

15. A process according to claim 14, wherein the first temperature is 980° C.

16. A process according to claim 14, wherein the first temperature is maintained for a period of four hours.

17. A process according to claim 13, further comprising:

cooling the sheet of magnetic steel after said first final annealing step at least partially secondarily recrystallizes said magnetically oriented grains; and wherein the second final annealing step comprises:

rapidly increasing the temperature at about 450° C. per hour until said first temperature is reached;

then increasing the temperature at about 40° C. per hour until said second temperature is reached, said second temperature being at least 1080° C. and not more than 1200° C.;

then maintaining the second temperature for a period of time which is at least a half hour and which is not more than five hours, under a hydrogen atmosphere; and then cooling the sheet of magnetic steel in a hydrogen atmosphere.

18. A process according to claim 17, further comprising maintaining the second temperature for four hours.

19. A process according to claim 13, further comprising providing the aluminum on said sheet of magnetic steel by placing at least one aluminum foil in contact with the sheet of magnetic steel.

20. A process according to claim 13, further comprising providing the aluminum on said sheet of magnetic steel by vacuum evaporation.

21. A process according to claim 13, further comprising providing the aluminum on said sheet of magnetic steel by immersion in a bath of molten aluminum.

* * * * *

UNITED STATES PATENT AND TRADEMARK OFFICE

CERTIFICATE OF CORRECTION

PATENT NO. : 5,123,976

DATED : June 23, 1992

INVENTOR(S) : BRISSONNEAU et al

It is certified that error appears in the above-identified patent and that said Letters Patent is hereby corrected as shown below:

Title page, left column, below Section [22], insert the following:

--[30] Foreign Application Priority Data

French Application No.90 01 362 filed February 6, 1990--

Signed and Sealed this

Twenty-fourth Day of August, 1993

Bruce Lehman

*Attest:*

BRUCE LEHMAN

*Attesting Officer*

*Commissioner of Patents and Trademarks*